US007897858B1

(12) United States Patent
Liao

(10) Patent No.: US 7,897,858 B1
(45) Date of Patent: Mar. 1, 2011

(54) DRUM RIM CLAMPING APPARATUS FOR A FOOT PEDAL HAMMER SEAT

(76) Inventor: Tsun-Chi Liao, Taichung (TW)

( * ) Notice: Subject to any disclaimer, the term of this patent is extended or adjusted under 35 U.S.C. 154(b) by 0 days.

(21) Appl. No.: 12/608,007

(22) Filed: Oct. 29, 2009

(51) Int. Cl.
*G10D 13/02* (2006.01)

(52) U.S. Cl. ..... 84/422.1

(58) Field of Classification Search ..... None
See application file for complete search history.

(56) References Cited

U.S. PATENT DOCUMENTS

| | | | | | |
|---|---|---|---|---|---|
| 2,132,211 | A * | 10/1938 | Hueckstead | 84/422.1 |
| 2,787,930 | A * | 4/1957 | Della-Porta | 84/422.1 |
| 3,055,254 | A * | 9/1962 | Haviland | 84/422.1 |
| 3,618,441 | A * | 11/1971 | Fearns | 84/422.1 |
| 3,722,349 | A * | 3/1973 | Hoellerich | 84/422.1 |
| 5,185,489 | A * | 2/1993 | Hoshino | 84/422.1 |
| 5,301,592 | A * | 4/1994 | Johnston | 84/422.1 |
| 5,427,010 | A * | 6/1995 | Hoshino | 84/422.1 |
| 5,557,054 | A * | 9/1996 | Shigenaga | 84/422.1 |
| 5,565,637 | A * | 10/1996 | Shigenaga | 84/422.1 |
| 5,627,332 | A * | 5/1997 | Lombardi | 84/422.1 |
| 5,726,370 | A * | 3/1998 | Yanagisawa | 84/422.1 |
| 5,936,177 | A * | 8/1999 | Shigenaga | 84/422.1 |
| 6,147,288 | A * | 11/2000 | Liao | 84/422.1 |
| 6,166,312 | A * | 12/2000 | Brewster et al. | 84/422.1 |
| 6,331,666 | B1 * | 12/2001 | Chang | 84/422.1 |
| 6,570,076 | B1 * | 5/2003 | Kjellgren | 84/422.1 |
| 6,596,934 | B2 * | 7/2003 | Hsieh | 84/422.1 |
| 6,632,990 | B2 * | 10/2003 | Menzel et al. | 84/422.1 |
| 6,765,141 | B2 * | 7/2004 | Shigenaga | 84/422.1 |
| 6,992,244 | B2 * | 1/2006 | Paul et al. | 84/422.1 |
| 7,381,877 | B2 * | 6/2008 | Shigenaga | 84/422.1 |
| 7,399,916 | B1 * | 7/2008 | Lombardi | 84/422.1 |
| 7,408,104 | B2 * | 8/2008 | Sato | 84/422.1 |
| 7,812,237 | B1 * | 10/2010 | Dunnett | 84/422.1 |
| 2007/0169611 | A1 * | 7/2007 | Chen | 84/422.1 |
| 2008/0196574 | A1 * | 8/2008 | Kjellgren | 84/422.1 |

* cited by examiner

*Primary Examiner*—Elvin G Enad
*Assistant Examiner*—Robert W Horn
(74) *Attorney, Agent, or Firm*—Muncy, Geissler, Olds & Lowe, PLLC

(57) ABSTRACT

A drum rim clamping apparatus for a foot pedal hammer seat to be installed on a base board at the front side of the hammer seat includes a turning arm located on the base board with one end hinged on the base board, an adjustment screw bar which is longitudinally screwed to a rack stand located at one side of the base board and has the bottom end butting another end of the turning arm downwards, and an elastic compressing element located at a distal end of a fine tune element. The fine tune element is fastened to a protrusive element at the front side of the turning arm to incorporate with a pair of pads located on the left and right sides of the base board to clamp a drum rim. A drummer can easily clamp the drum rim without being interfered by other elements and butting the pedal.

10 Claims, 6 Drawing Sheets

DRUM RIM CLAMPING APPARATUS FOR A FOOT PEDAL HAMMER SEAT

FIELD OF THE INVENTION

The present invention relates to a foot pedal hammer seat and particularly to a clamping apparatus located in front of a foot pedal hammer seat to clamp a drum rim of a bass drum.

BACKGROUND OF THE INVENTION

A conventional foot pedal hammer seat is used for clamping a bass drum as shown in FIGS. 1, 2 and 3. It mainly includes a hammer seat 1*a* placed on the floor with a base board 2*a* at the front side thereof, and a pair of rack stands 3*a* at the left and right sides of the base board 2*a* having the top to jointly hinge an axle 4*a*. The axle 4*a* runs through a hub 5*a* which has one side fastened to a hammer 6*a*. The hammer seat 1*a* has a rear side hinged a pedal 7*a*. The pedal 7*a* has a front side fastened to one end of a chain 8*a*. The pedal 7*a* also has a front end higher than a rear end in an inclined manner. The chain 8*a* has another end fastened to the hub 5*a*. A clamping means 9*a* is hinged on the base board 2*a*. The clamping means 9*a* is run through in the middle by a transverse axle 10*a* to be hinged on the base board 2*a*. The clamping means 9*a* further has a pressing jaw 11*a* transversely hinged at the front side above the base board 2*a* to jointly clamp a drum rim a of the bass drum. The clamping means 9*a* further has a screw hole at the rear side screwed by a pressing bolt 12*a* with a distal end butting the upper side of the base board 2*a*.

The pedal 7*a* can be stepped downwards by a user's foot so that the chain 8*a* drags the hub 5*a* to turn to drive the upper end of the hammer 6*a* to strike the face of the bass drum to generate drum sound.

Referring to FIG. 2, the drum rim a of the bass drum usually has an elastic protection pad b attached thereon for protection. This increases the clamping distance between the pressing jaw 11*a* and the base board 2*a*. And the pressing bolt 12*a* is screwed in a screw hole of the clamping means 9*a* at another end at a shorter distance. FIG. 3 illustrates another conventional approach for a thinner drum rim a. The pressing jaw 11*a* directly compresses and clamps the drum rim a incorporating with the base board 2*a*. The clamping means 9*a* is tilted upwards at the rear side and the pressing bolt 12*a* extends downwards out of the screw hole at a greater distance after screwing into the clamping means 9*a*. To suit varying thickness of the drum rim a, the length of the pressing bolt 12*a* has to be made longer. But the longer pressing bolt 12*a* creates a concern of butting the pedal 7*a* at the top. Moreover, in the event that a drummer wants to tighten the pressing bolt 12*a*, his/her hand has to reach into the narrow space beneath the pedal 7*a* to fumble and wrench the pressing bolt 12*a*. It is a troublesome operation.

In addition, as shown in FIG. 1, the bass drum usually is positioned at a slight tilted angle in front of the hammer seat 1*a*. The extent of the tilted angle depends on the preference of the drummer. As a result, the drum rim a also is clamped by the pressing jaw 11*a* and the base board 2*a* in a tilted manner. When the hammer strikes the drum face, the drum rim a is subject to a torsional force. This results in warp and deformation of the drum rim a after a period of time in use.

SUMMARY OF THE INVENTION

Therefore, the primary object of the present invention is to provide a drum rim clamping apparatus for a foot pedal hammer seat to clamp the drum rim to facilitate tightening operation, prevent screwing and compressing elements from butting the pedal, and also provide secure clamping without damaging the drum rim.

To achieve the foregoing object, the drum rim clamping apparatus according to the invention is located on a base board at a front side of a hammer seat. The base board has a pair of elastic pads made from rubber on the left side and right side at the front side thereof. The hammer seat has a rear side hinged a pedal which has the front side higher than the rear side. A pair of rack stands are provided on the left side and right side of the base board. The rack stands are transversely hinged with an axle which further hinges a hub. The hub is connected to the front end of the pedal through a flexible band. The hub has one side fastened to a hammer. The hammer has a distal end fastened to a drumstick. The invention further has a turning arm, an elastic compressing element and an adjustment screw bar.

The turning arm is transversely located at the front end of the base board with one end hinged thereon.

The elastic compressing element is coupled on a protrusive element at the front side of the turning arm and coupled with a distal end of a longitudinal fine tune element. The fine tune element is fastened to the protrusive element. The elastic compressing element and the pads jointly clamp a drum rim.

The adjustment screw bar is fastened to one of the rack stands in a longitudinal manner, and has the bottom end butting downwards to another end of the turning arm.

The invention thus structured provides many benefits, notably:

1. The turning arm is located at the front end of the base board with another end pressing downwards. The adjustment screw bar to clamp the drum rim is located at the front side of the rack stand. The fine tune element is located at the front end of the pedal. Hence drummers can wrench the adjustment screw bar or the fine tune element according to varying thickness of the drum rim without being interfered by other elements or butting the pedal.

2. The invention provides a structure to clamp the drum rim at a greater scale by wrenching the adjustment screw bar downwards to butt another end of the turning arm downwards so that the elastic compressing element can compress the drum rim tightly. To adjust the fine tune element can drive the elastic compressing element horizontally to compress the drum rim to suit the drum rim of varying thickness. By wrenching the adjustment screw bar, user's hands do not have to fumble under the pedal, so that operation is much easier.

3. The invention provides the rubber elastic compressing element and two pads on the left and right sides that are positioned to tilt downwards and inwards from outer sides to match the arched drum rim to form compression. This also can prevent damage the face of the drum rim.

The foregoing, as well as additional objects, features and advantages of the invention will be more readily apparent from the following detailed description, which proceeds with reference to the accompanying embodiment and drawings. The embodiment serves only for illustrative purpose and is not the limitation of the invention.

DETAILED DESCRIPTION OF THE PREFERRED EMBODIMENT

Figure 1:
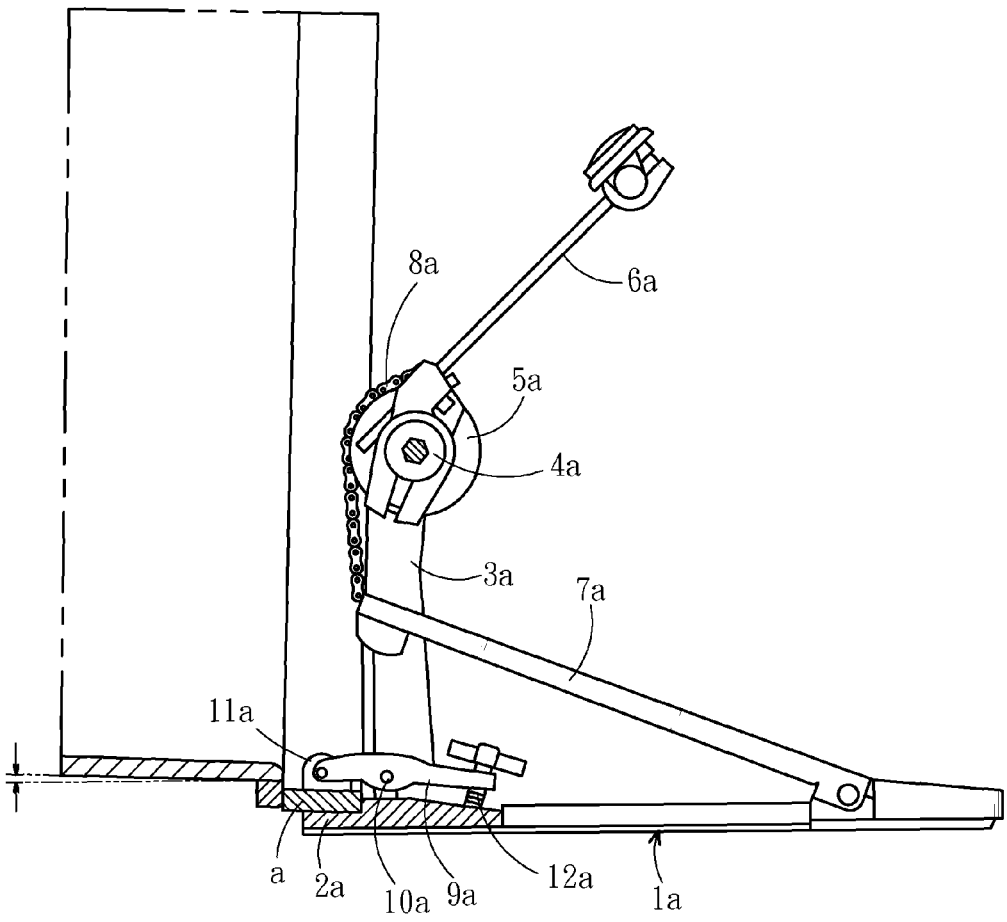
Fig. 1 PRIOR ART
FIG. 1 is a plane view of the structure of a conventional foot pedal hammer seat clamping a bass drum.
Figure 2:
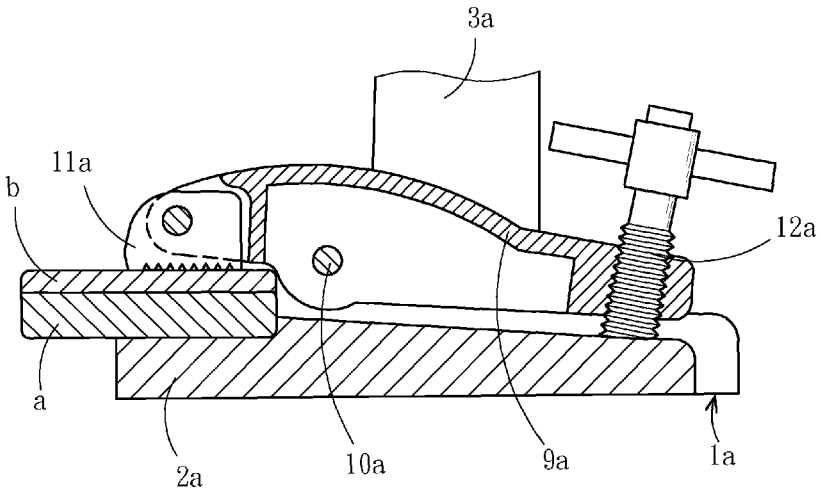
Fig. 2 PRIOR ART
FIG. 2 is a schematic view of the structure of a conventional foot pedal hammer seat clamping a bass drum of a thicker drum rim.
Figure 3:
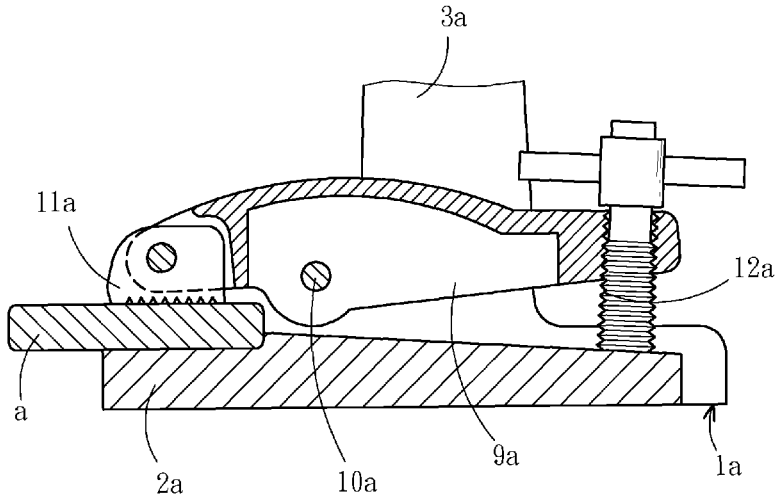
Fig. 3 PRIOR ART
FIG. 3 is a schematic view of the structure of a conventional foot pedal hammer seat clamping a bass drum of a thinner drum rim.
Figure 4:
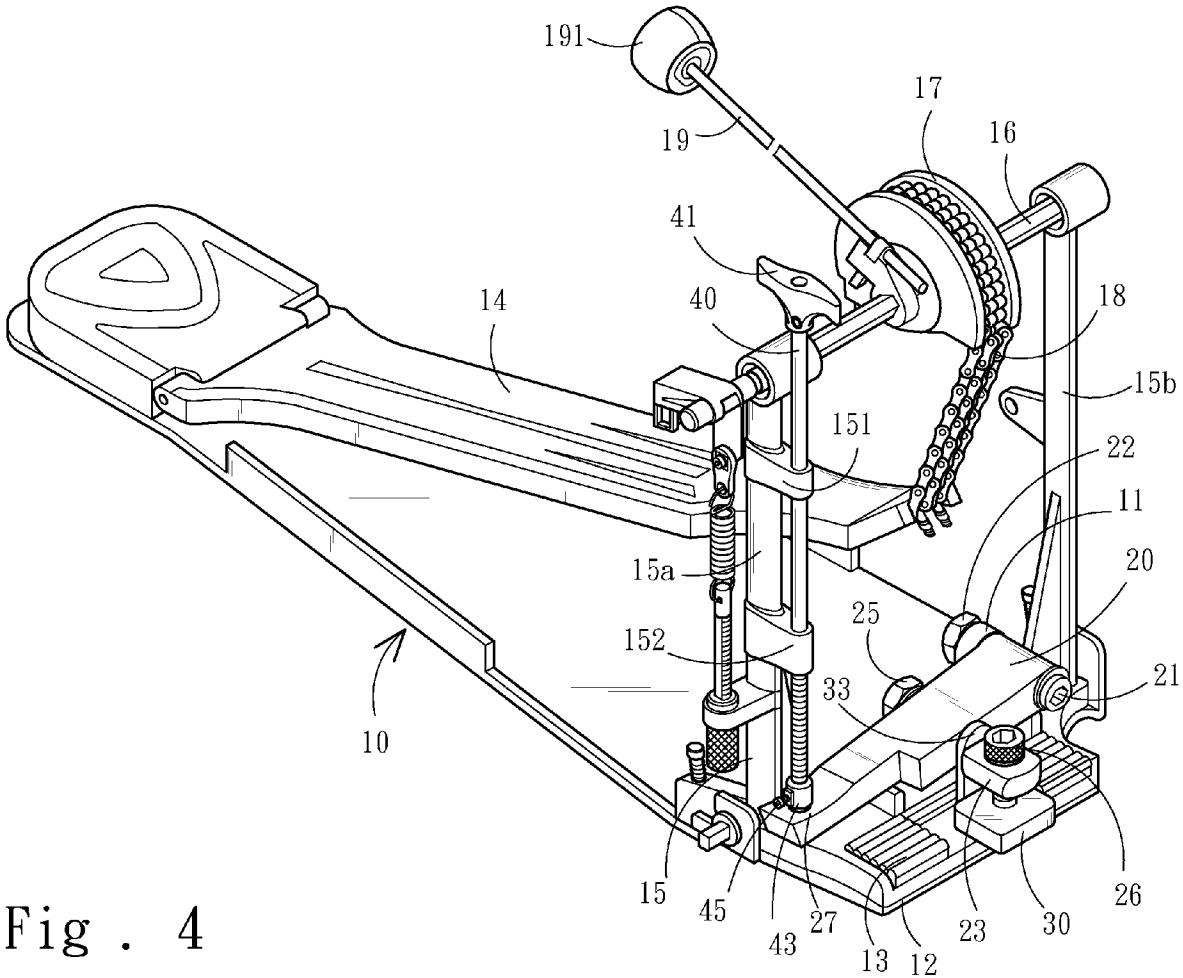
FIG. 4 is a perspective view of an embodiment of the invention.
Figure 5:
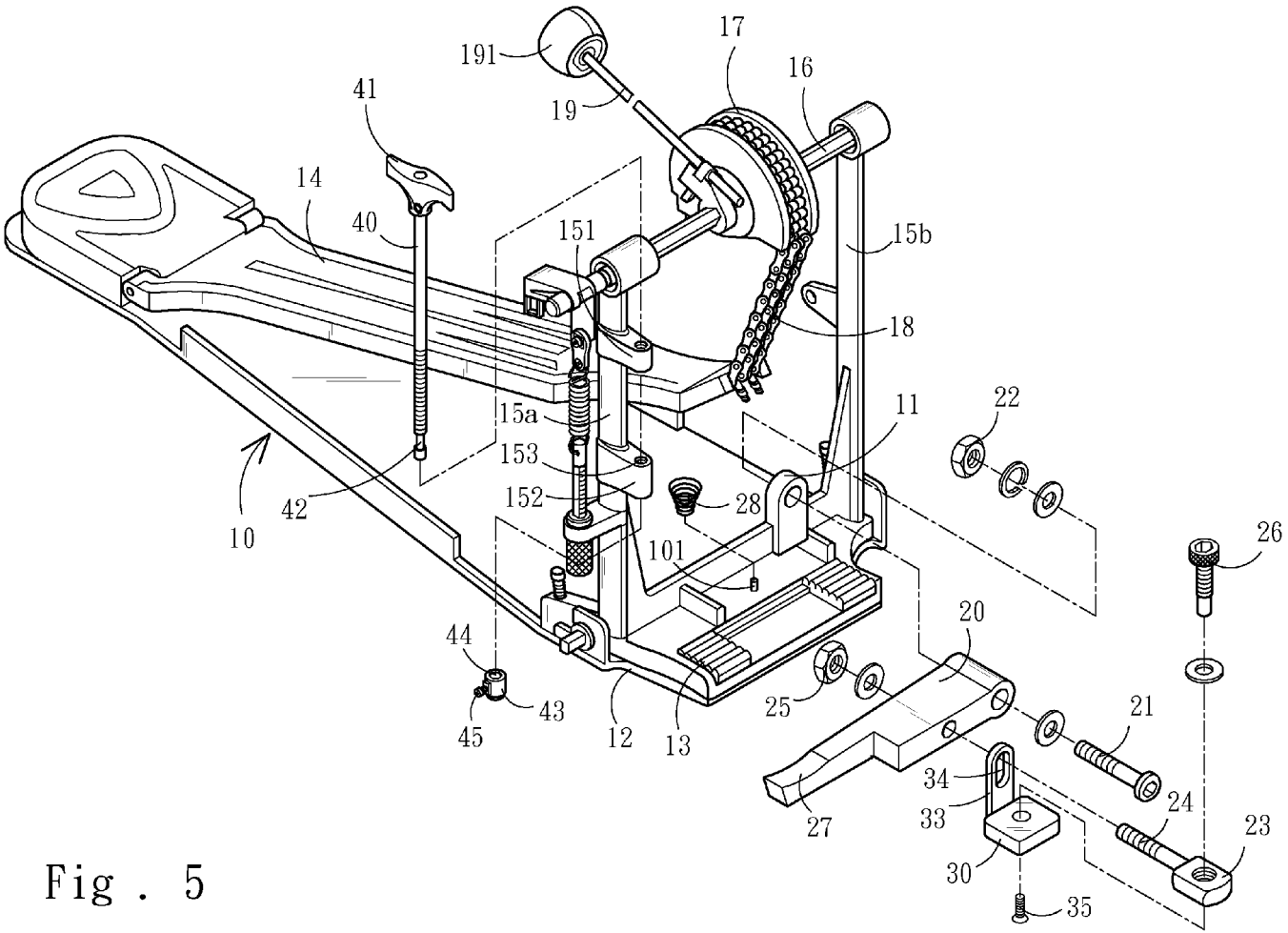
FIG. 5 is an exploded view of an embodiment of the invention.

Please refer to FIGS. 4 and 5 for an embodiment of the invention. The present invention aims to provide a drum rim clamping apparatus for a foot pedal hammer seat to be installed on a base board 12 at a front side of a hammer seat 10. The base board 12 has a protrusive portion 11 extended upwards and a pair of elastic pads 13 made of rubber and located on the left and right sides in front of the base board 12. The pads 13 are tilted downwards and inwards from outer sides. The hammer seat 10 has a rear side hinged a pedal 14 which has the front side higher than the rear side in the tilted manner. There are also a pair of rack stands 15*a* and 15*b* located on the left and right sides of the base board 12, and the rack stands 15*a* and 15*b* are transversely hinged an axle 16 at a upper side. The axle 16 is hinged on a hub 17 which is connected to the front end of the pedal 14 through a flexible band 18. The hub 17 has one side fastened to a hammer 19 which has a distal end fastened to a drumstick 191. The rack stand 15*a* has a first lug 151 and a second lug 152 at the front side located on an upper side and a lower side. The second lug 152 has a screw hole 153. The invention further has a turning arm 20, an elastic compressing element 30 and an adjustment screw bar 40.

The turning arm 20 is transversely located at the front end of the base board 12, and has one end hinged on the protrusive portion 11 on the base board 12, and a pressed portion 27 at another end formed with an arched downward concave on the upper surface. A bar-type hinged element 21 (such as a bolt) is provided to run through one end of the turning arm 20 and the protrusive portion 11 from the front side to the rear side and fasten to a nut 22. A block-type protrusive element 23 is provided to fasten to the front side of the turning arm 20. The protrusive element 23 has a screwing portion 24 at the rear side to run through rearwards the turning arm 20 to fasten to another nut 25. The protrusive element 23 has the top fastened to a fine tune element 26 (such as a pressing bolt) in the longitudinal manner. The fine tune element 26 is screwed with the protrusive element 23 and thus is supported by the protrusive element 23. The turning arm 20 and the base board 12 are interposed by a returning spring 28 which has the bottom coupled on a retaining strut 101 located at the front side of the base board 12.

Figure 6:
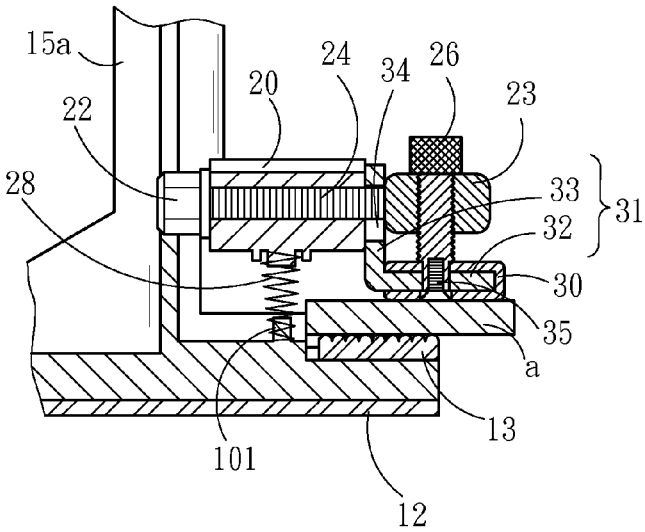
FIG. 6 is a sectional view of an embodiment of the invention showing a fine tune element and a lug in a coupled condition.

The elastic compressing element 30 (such as a rubber block) is located at the front side of the turning arm 20 to join the pads 13 to clamp a drum rim a. Also referring to FIGS. 6 and 8, a metal lug 31 is provided beneath the protrusive element 23 that has a horizontal bottom 32 and a longitudinal top 33 joined in an L-shaped manner. The longitudinal top 33 has a longitudinal slot 34. The horizontal bottom 32 is encased by the elastic compressing element 30 at the outer periphery.

The fine tune element 26 has a distal end longitudinally running through the horizontal bottom 32 and the elastic compressing element 30 is run through upwards by a coupling screw 35 from the bottom of the elastic compressing element 30 so that the fine tune element 26 and the horizontal bottom 32 are coupled together.

The adjustment screw bar 40 runs longitudinally through the first lug 151 of the rack stand 15*a* and fastens to the screw hole 153 of the second lug 152, and also has a butterfly nut 41 at the top and a neck 42 at the bottom end.

Figure 7:
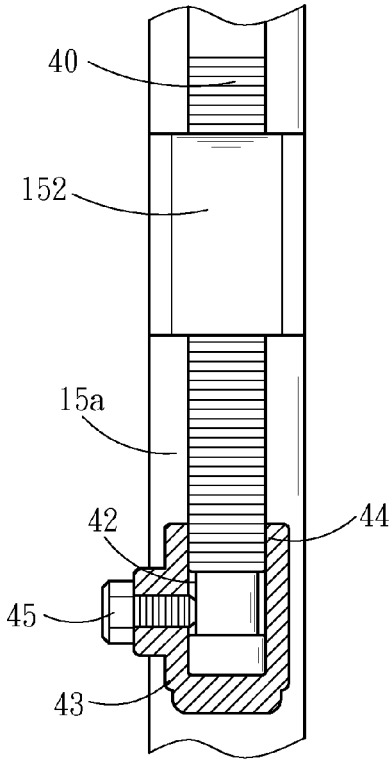
FIG. 7 is a schematic view of an embodiment of the invention showing an adjustment screw bar and a butting member in a coupled condition.

Referring to FIG. 7, a post-type butting member 43 is provided a cavity 44 formed in the center without running through the bottom thereof. The cavity 44 is coupled with the bottom end of the adjustment screw bar 40. The butting member 43 is fastened transversely by a retaining screw 45 on the outer perimeter. The retaining screw 45 has a distal end butting the neck 42. The butting member 43 has the bottom butting the pressed portion 27 of the turning arm 20.

Figure 8:
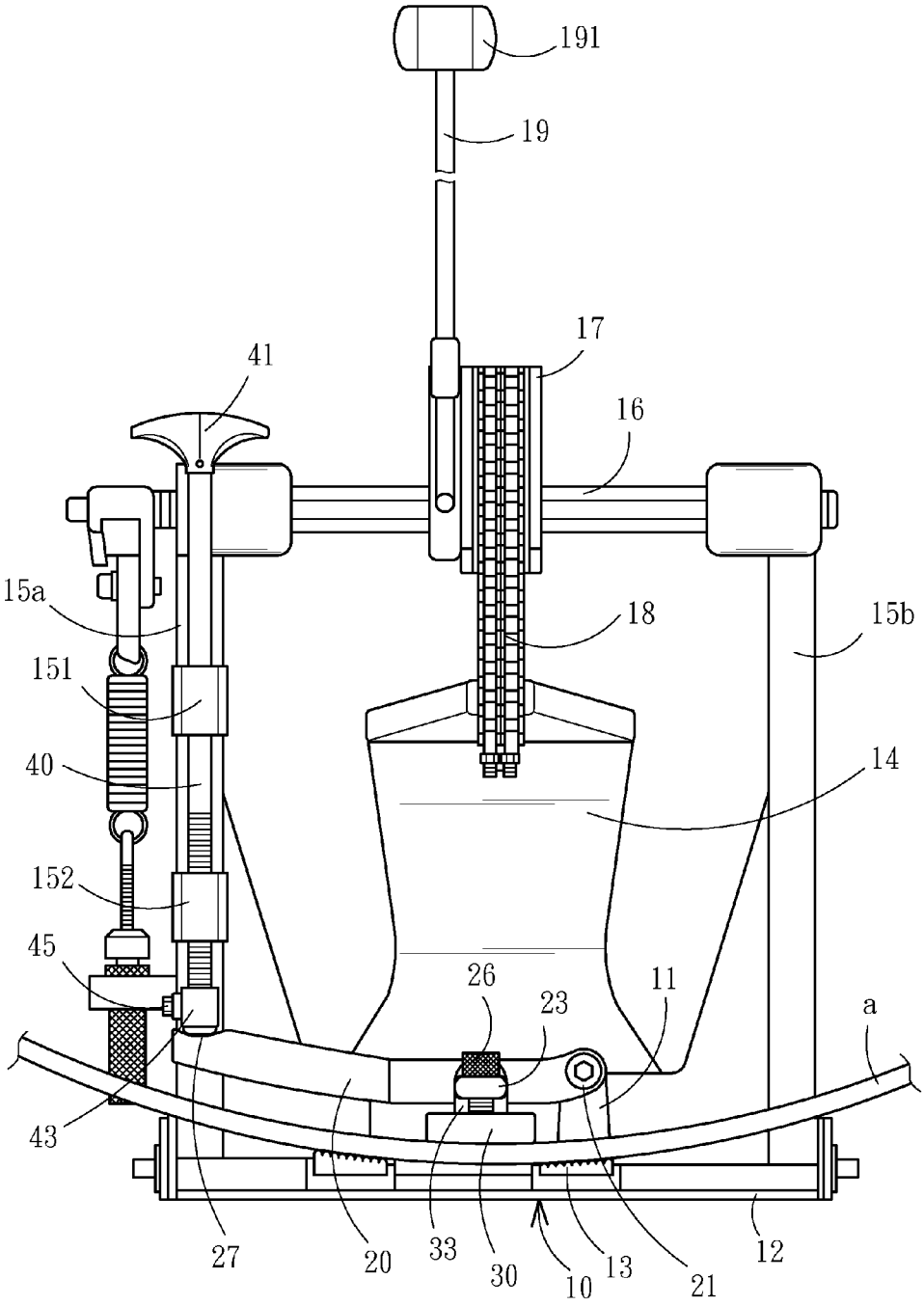
FIG. 8 is a plane view of an embodiment of the invention incorporating with a drum rim.

Also referring to FIG. 8, through the construction set forth above, the elastic compressing element 30 and the two pads 13 on the left and right sides of the base board 12 form a gap to clamp the drum rim a. The butterfly nut 41 of the adjustment screw bar 40 can be wrenched to move the butting member 43 which is located at the lower end of the adjustment screw bar 40 downwards to compress the turning arm 20 downwards and press and fix the drum rim a. By unfastening the adjustment screw bar 40, the other end of the turning arm 20 is moved upwards by the returning force of returning spring 28.

In addition, screwing the fine tune element 26 can drive the elastic compressing element 30 downwards to further compress the drum rim a.

Thus a drummer can step the pedal 14 to drag the flexible band 18 downwards and drive the hub 17 to turn and the hammer 19 rotating so that the drumstick 191 can further strike the drum face to generate drum sound.

The invention provides many advantages, notably:

1. The turning arm 20 is located at the front end of the base board 12. The adjustment screw bar 40 used to compress the drum rim a is located at the front side of the rack stand 15*a*, and the fine tune element 26 is located at the front end of the pedal 14. Hence the drummer can wrench the adjustment screw bar 40 or the fine tune element 26 according to varying thickness of the drum rim a. And drummer's hands do not have to fumble beneath the pedal 14 and also are not interfered by other elements, and the concern of butting the pedal 14 can also be avoided.

2. The invention provides a structure to clamp the drum rim a at a greater scale by wrenching the adjustment screw bar 40 to compress another end of the turning arm 20 downwards so that the elastic compressing element 30 can rapidly clamp the drum rim a. To slightly adjust the fine tune element 26 also can drive the elastic compressing element 30 horizontally to press the drum rim a. Thus it can be used on the drum rim a of varying thickness. Moreover, the drummer can wrench the adjustment screw bar 40 without bending the body greatly.

3. The elements of the invention used to compress the drum rim a are the elastic compressing element 30 made of rubber and the two elastic pads 13 on the left and right sides that tilt downwards and inwards from the outer sides, thus can match the arched drum rim a without damaging the surface thereof.

What is claimed is:

1. A drum rim clamping apparatus for a foot pedal hammer seat to be installed on a base board at a front side of the hammer seat, the base board having a pair of elastic pads at a front side on a left side and a right side thereof, the hammer seat having a rear end hinged a pedal which has a front side higher than a rear side, the base board also having a pair of rack stands on the left side and the right side, the rack stands being transversely hinged by an axle which further hinges a hub, the hub being fastened to a front end of the pedal through a flexible band and having one side fastened to a hammer which has a distal end fastened to a drumstick, the drum rim clamping apparatus comprising:

a turning arm which is transversely located at the front end of the base board and has one end hinged on the base board;

an adjustment screw bar which is longitudinally screwed to one rack stand and has a bottom end butting another end of the turning arm downwards; and an elastic compressing element which is located at a front side of the turning arm and at a distal end of a longitudinal fine tune element, the fine tune element being fastened to the turning arm to incorporate with the pads to clamp a drum rim.

2. The drum rim clamping apparatus of claim 1, wherein the front side of the turning arm has a protrusive element located thereon to fasten and support the fine tune element.

3. The drum rim clamping apparatus of claim 2, wherein the protrusive element has a screwing portion at a rear side and a lug located below, the lug having a horizontal bottom and a longitudinal top that are connected in an L-shape, the longitudinal top having a longitudinal slot, the horizontal bottom being encased by the elastic compressing element, and the screwing portion running through the slot and the turning arm to fasten to a nut.

4. The drum rim clamping apparatus of claim 3, wherein the elastic compressing element has a bottom run through by an upward coupling screw to fasten the fine tune element.

5. The drum rim clamping apparatus of claim 1, wherein the base board has a protrusive portion extended upwards from the front side, and the turning arm and the protrusive portion run through by a post-type hinged element which fastens to another nut.

6. The drum rim clamping apparatus of claim 1, wherein the adjustment screw bar has a butterfly nut formed on the top thereof.

7. The drum rim clamping apparatus of claim 1, wherein the rack stand coupled with the adjustment screw bar has a first lug and a second lug at the front side in up and down manner, the first lug being run through by the adjustment screw bar, the second lug having a screw hole screwed with the adjustment screw bar, the adjustment screw bar having a neck at the bottom end, a butting member having a cavity formed in the center to couple with the bottom end of the adjustment screw bar and transversely fastened by a retaining screw on the outer perimeter thereof, the retaining screw having a distal end butting the neck, the butting member butting another end of the turning arm downwards.

8. The drum rim clamping apparatus of claim 7, wherein another end of the turning arm has a pressed portion formed on an upper side in an arched downward concave to be downward butted by the butting member.

9. The drum rim clamping apparatus of claim 1, wherein the pads are tilted downwards and inwards from outer sides.

10. The drum rim clamping apparatus of claim 1, wherein the turning arm and the base board are interposed by a returning spring which has the bottom coupled on a retaining strut located at the front side of the base board.

* * * * *